US008745766B2

(12) United States Patent
Tarrant et al.

(10) Patent No.: US 8,745,766 B2
(45) Date of Patent: Jun. 10, 2014

(54) BATHING GARMENT SET

(75) Inventors: Neil Thomas Tarrant, Austin, TX (US); Stacy Davis Tarrant, Austin, TX (US)

(73) Assignee: Neil Tarrent, Austin, TX (US)

( * ) Notice: Subject to any disclaimer, the term of this patent is extended or adjusted under 35 U.S.C. 154(b) by 0 days.

(21) Appl. No.: 13/333,371

(22) Filed: Dec. 21, 2011

(65) Prior Publication Data

US 2013/0160177 A1 Jun. 27, 2013

(51) Int. Cl.
*A41D 5/00* (2006.01)

(52) U.S. Cl.
USPC ..... 2/67

(58) Field of Classification Search
USPC ..... 2/67, 69, 71, 72, 73, 74, 75, 80, 83, 2/111, 114, 115, 128, 96
See application file for complete search history.

(56) References Cited

U.S. PATENT DOCUMENTS

| | | | | |
|---|---|---|---|---|
| 1,311,600 | A * | 7/1919 | Fiore | 2/80 |
| 2,805,590 | A * | 9/1957 | Nelson | 29/741 |
| 3,771,172 | A * | 11/1973 | Barg | 2/67 |
| 5,079,779 | A * | 1/1992 | Spector et al. | 2/106 |
| 6,237,152 | B1 * | 5/2001 | Gootrad | 2/87 |
| 6,698,025 | B1 * | 3/2004 | Hughes | 2/69 |

* cited by examiner

*Primary Examiner* — Tejash Patel

(57) ABSTRACT

A novel bathing garment set for taking showers in public places. Oversized, snap-fastened shirt tops and shorts are designed for easily putting on and disrobing normal clothes in public with privacy. Made of semi-permeable fabrics, the bathing garment is to be worn during a shower and while washing.

5 Claims, 13 Drawing Sheets

BATHING GARMENT SET

DESCRIPTION OF RELATED ART

The present application relates to a set of bathing suits, and more particularly to a set of bathing garments that help alleviate embarrassment and awkwardness of having to take a bath or shower in an open or public place.

Note that the points discussed below may reflect the hindsight gained from the disclosed inventions and are not necessarily admitted to be prior art.

There are many different bathing suits in the market and in patent application publications. Some designs for better aesthetic feel, some for practical use. For example, US Patent Application Publication US 2009/0235424 A1 describes a bathing suit top to minimize the tension felt on the neck of a wearer. US 2009/0049576 A1 describes a pair of bathing shorts that prevent hip hemline from rising while walking. All these conventional designs seem to aim at tightly fitting the bathing suits with the body. And these bathing suits do not provide a way for dealing with embarrassment when having to take a shower or bathe in public.

SUMMARY

The present application discloses new approaches to bathing/shower garments that meet the need of alleviating the stress, embarrassment and awkwardness of having to shower or bathe in an open or public place.

In one embodiment, a loosely fitting bathing/shower shorts and tops with snap fasteners are made with semi-permeable mesh fabrics that can be dried with a towel.

In one aspect of an embodiment, Velcro®, magnetic buttons or zippers are used for easy opening of a bathing garment so that a wearer can disrobe modestly.

In one aspect of an embodiment, a drawstring is inserted at the waistband and a cord stop is used to keep the drawstring tight while keeping the hands free.

The disclosed various embodiments will allow athletes, swimmers, students, dormitory residents, military personnel, detainees in correction facilities, assisted living residents and hazardous material handlers to shower in a public or open shower with sufficient privacy and ease. People can discreetly disrobe, wash, rinse and privately dress through the garment.

BRIEF DESCRIPTION OF THE DRAWINGS

The disclosed application will be described with reference to the accompanying drawings, which show sample embodiments and which are incorporated in the specification hereof by reference, wherein.

DETAILED DESCRIPTION OF SAMPLE EMBODIMENTS

Figure 1A:
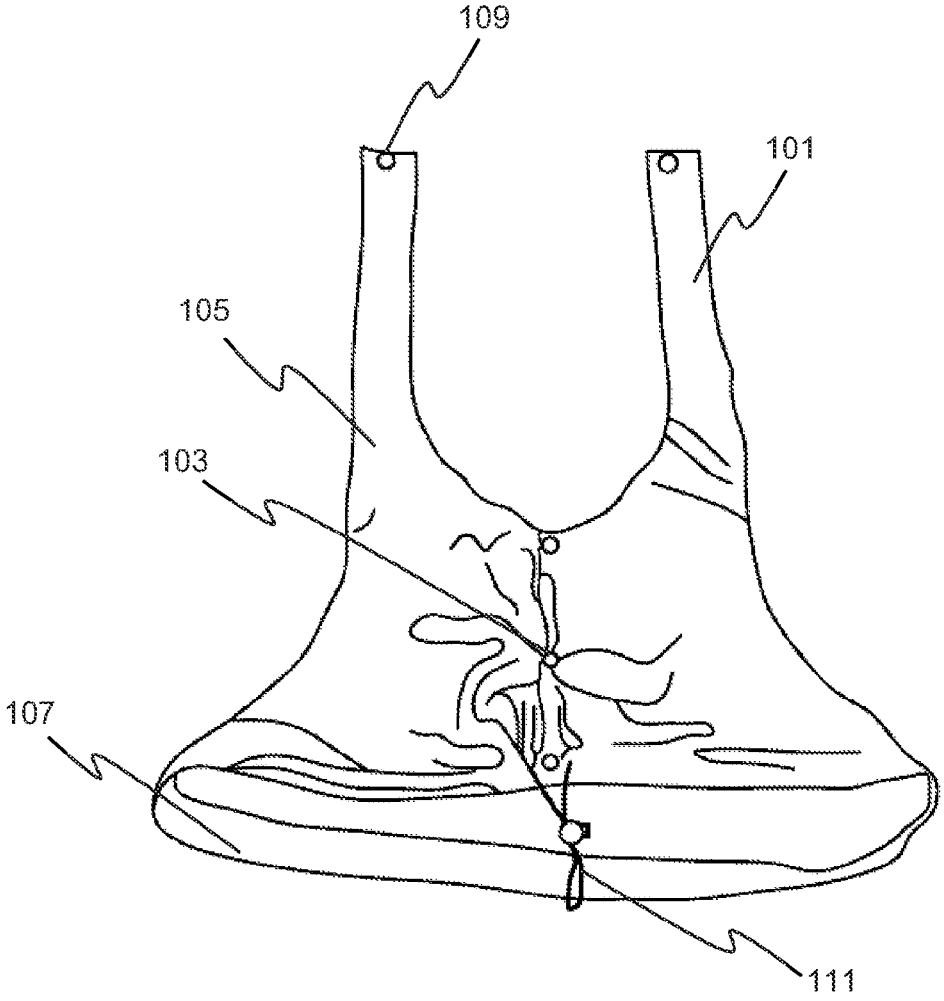
FIG. 1A is a perspective view of an example shirt halter front in accordance in this application.

The numerous innovative teachings of the present application will be described with particular reference to presently preferred embodiments (by way of example, and not of limitation). The present application describes several embodiments, and none of the statements below should be taken as limiting the claims generally.

For simplicity and clarity of illustration, the drawing figures illustrate the general manner of construction, and description and details of well-known features and techniques may be omitted to avoid unnecessarily obscuring the invention. Additionally, elements in the drawing figures are not necessarily drawn to scale. Some areas or elements may be expanded to help improve understanding of embodiments of the invention.

The terms "first," "second," "third," "fourth," and the like in the description and the claims, if any, may be used for distinguishing between similar elements and not necessarily for describing a particular sequential or chronological order. It is to be understood that the terms so used are interchangeable. Furthermore, the terms "comprise," "include," "have," and any variations thereof, are intended to cover non-exclusive inclusions, such that a process, method, article, apparatus, or composition that comprises a list of elements is not necessarily limited to those elements, but may include other elements not expressly listed or inherent to such process, method, article, apparatus, or composition.

It is contemplated and intended that the designs may be made of any suitable semi-permeable fabric. The preferred embodiments are made of polyester jersey mesh fabric.

Figure 1B:
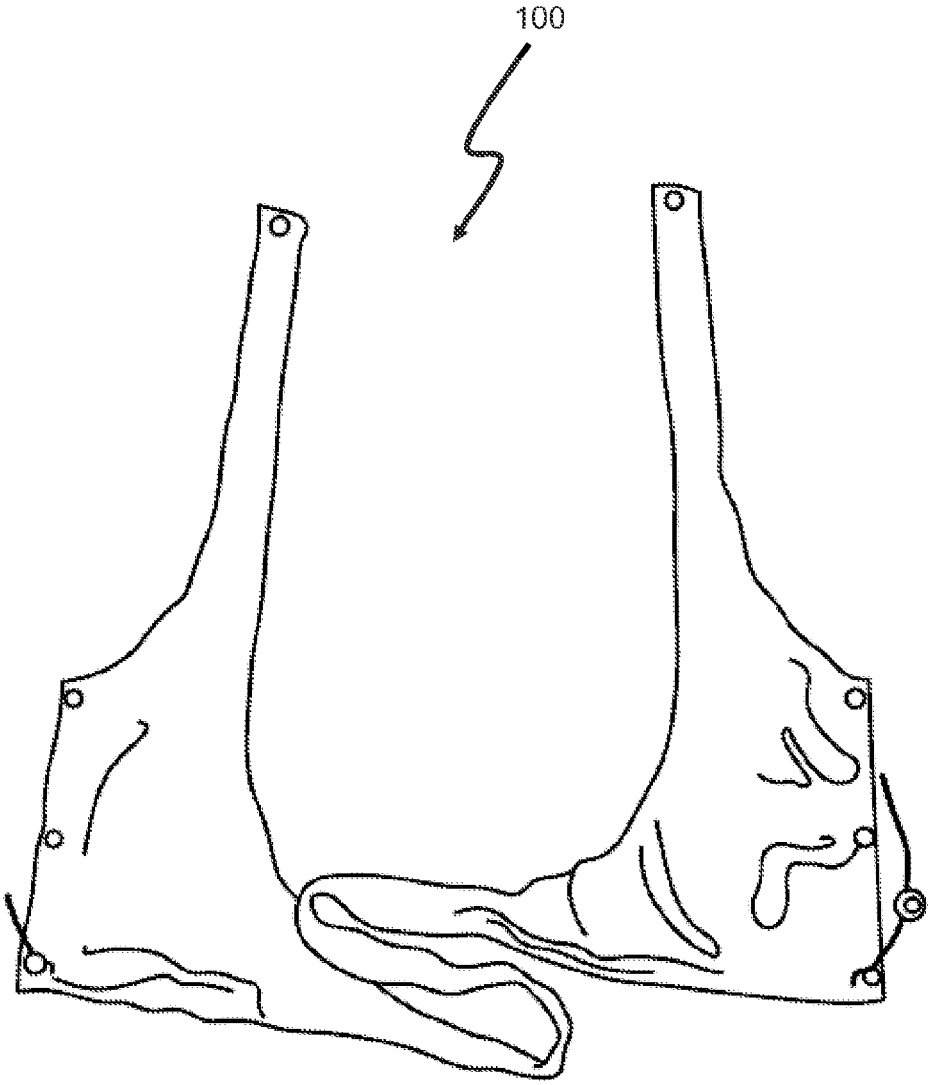
FIG. 1B is a perspective view of an example unfastened shirt halter outside in accordance in this application.
Figure 1C:
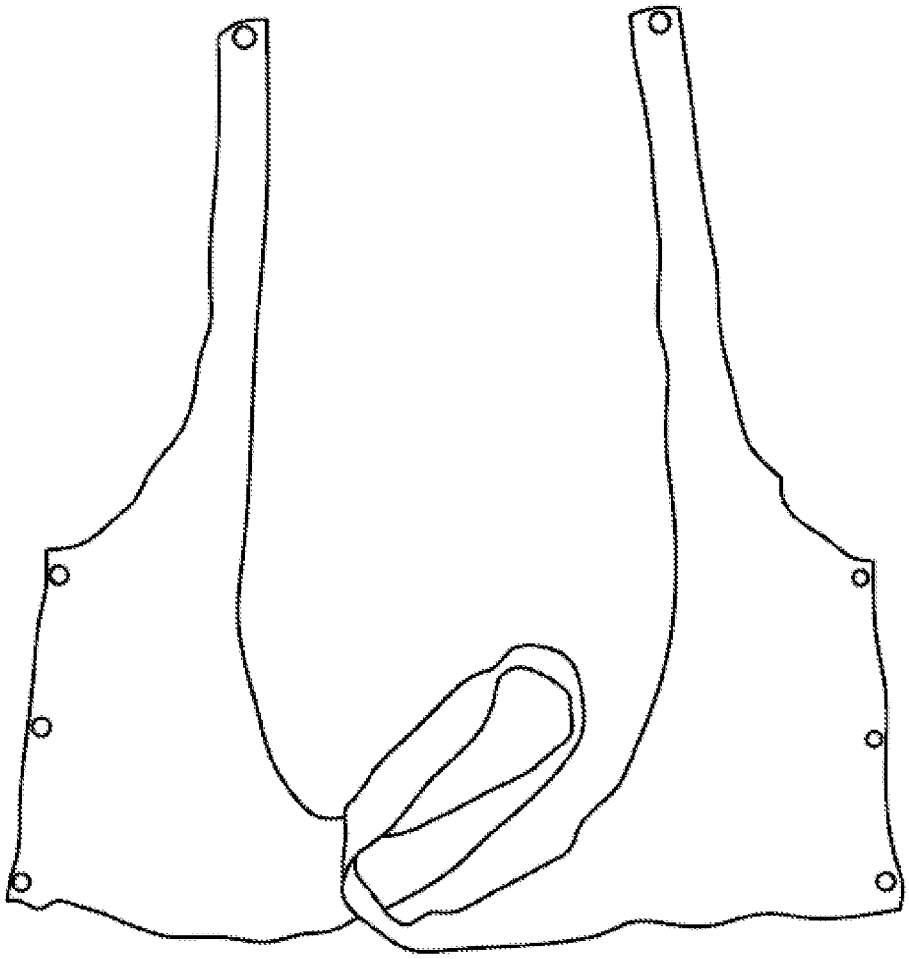
FIG. 1C is a perspective view of an example unfastened shirt halter inside in accordance in this application.

In reference to FIGS. 1A to 1C, shower top 100 for showering in an open place is a shirt halter design having three panels, two front panels 105 and one back panel 107. Front panels 105 come together in the front in between the "cups." The panels are not sewn together. The fabric is hemmed and fastened with snap fasteners 103 that run vertically. Other types of fastener options include Velcro®, magnetic buttons and sewing. The easily snap-open front panel design allows the shower top 100 to be put on and taken off even if the user is wearing other clothing.

Shower top 100 has a loose fitting waistband that is sewn into the bottom of the shower top 100. Within the waistband, drawstring 111 is inserted so the waistband can be cinched. There are buttonholes sewn at the front of the waistband to where the drawstring extends. A cord stop is used to keep the drawstring tight while keeping the hands free. One side of the drawstring is able to be removed from the cord stop and can be easily replaced into the cord stop. This allows for front panels 105 to be completely separated. The panels are oversized in design. When snaps 103 are unfastened and the drawstring is loosened, shower top 100 can be easily removed if clothes are worn underneath. In addition, if other clothes are worn, the shower top 100 can be easily put on over the clothing and then the user can dress or disrobe with sufficient privacy.

Two neck straps 101 extend upwards from front panels 105 and can be joined behind the neck. The ends of each strap 101 are hemmed and fastened with snap fasteners 109. Other types of fasteners options include Velcro®, magnetic buttons and sewing.

Figure 2A:
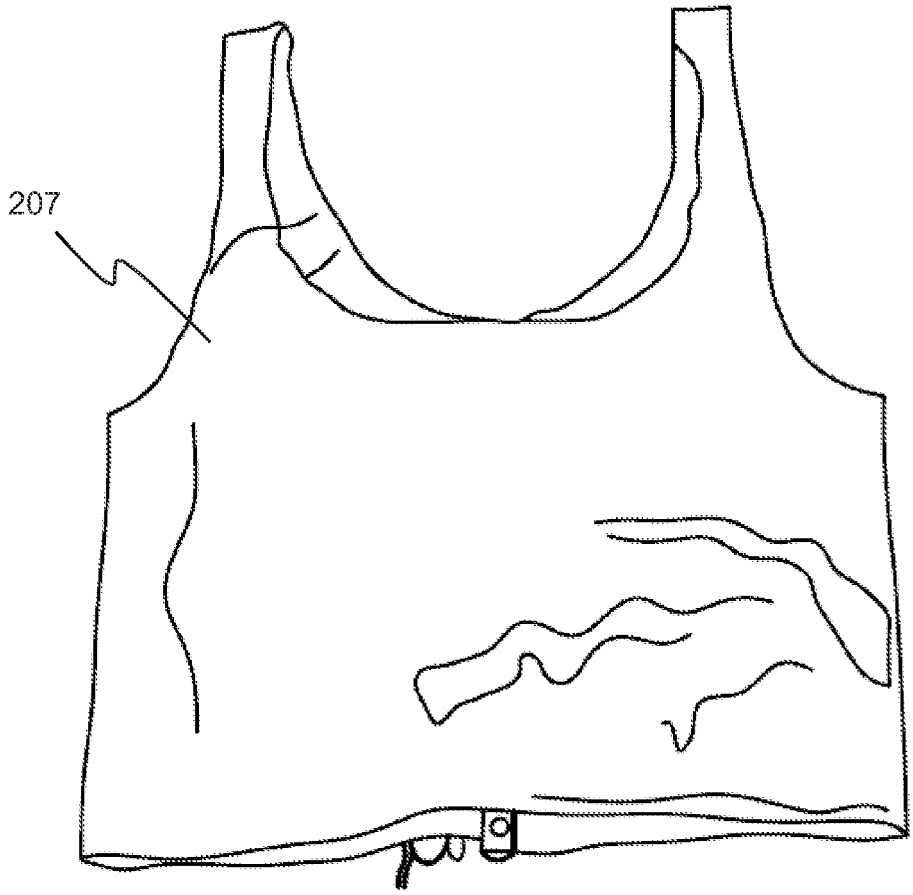
FIG. 2A is a perspective view of an example shirt tank back in accordance in this application.
Figure 2B:
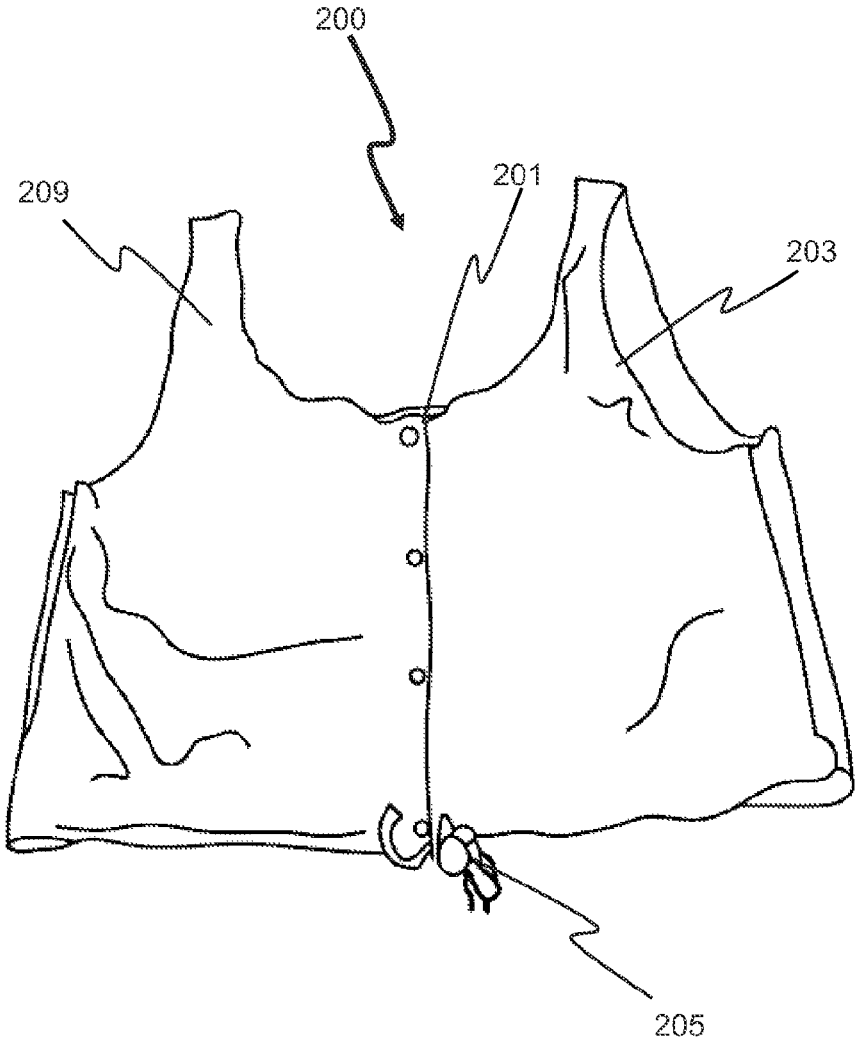
FIG. 2B is a perspective view of an example shirt tank front in accordance in this application.
Figure 2C:
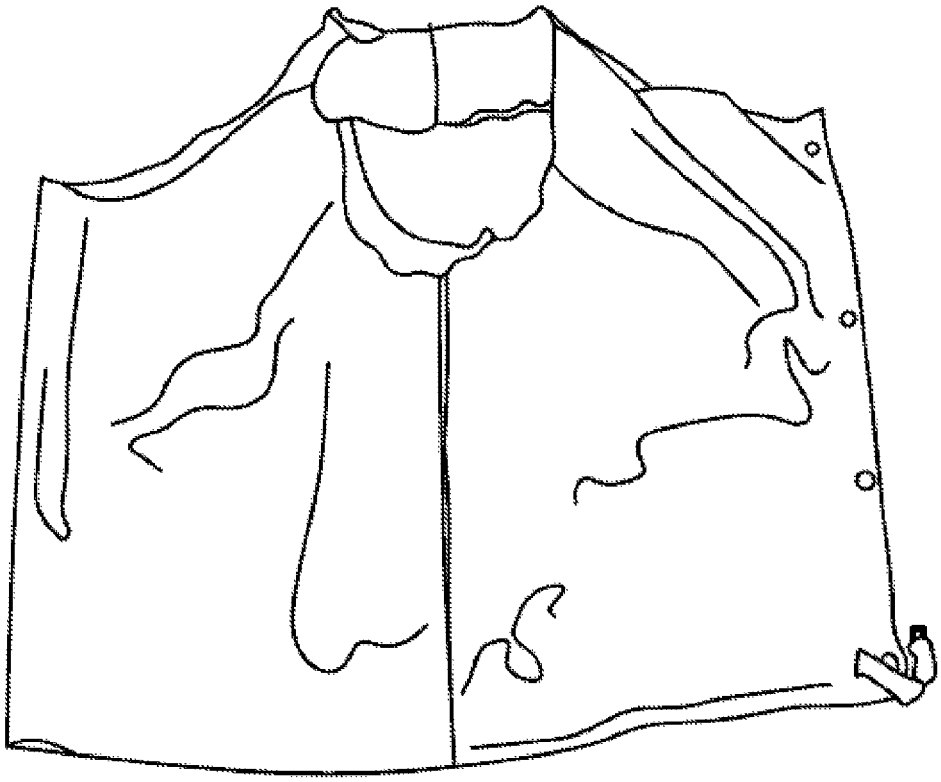
FIG. 2C is a perspective view of an example shirt tank side in accordance in this application.
Figure 2D:
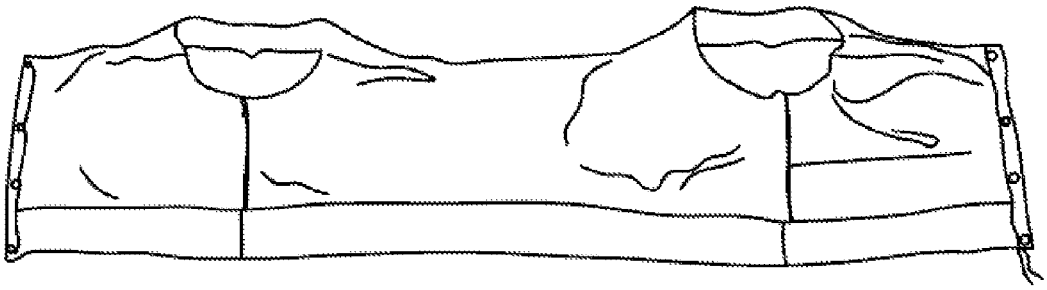
FIG. 2D is a perspective view of an example unfastened shirt tank inside in accordance in this application.
Figure 2E:
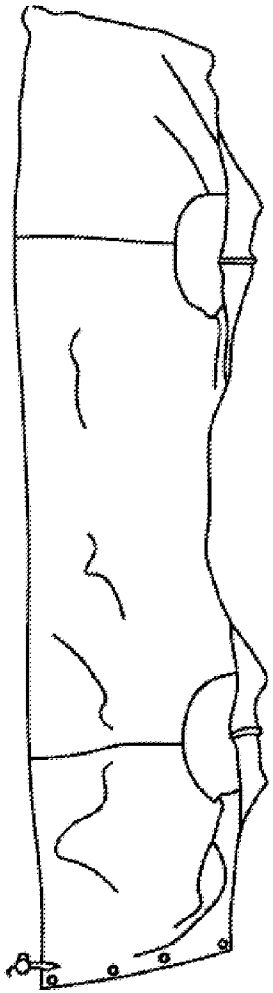
FIG. 2E is a perspective view of an example unfastened shirt tank outside in accordance in this application.
Figure 3A:
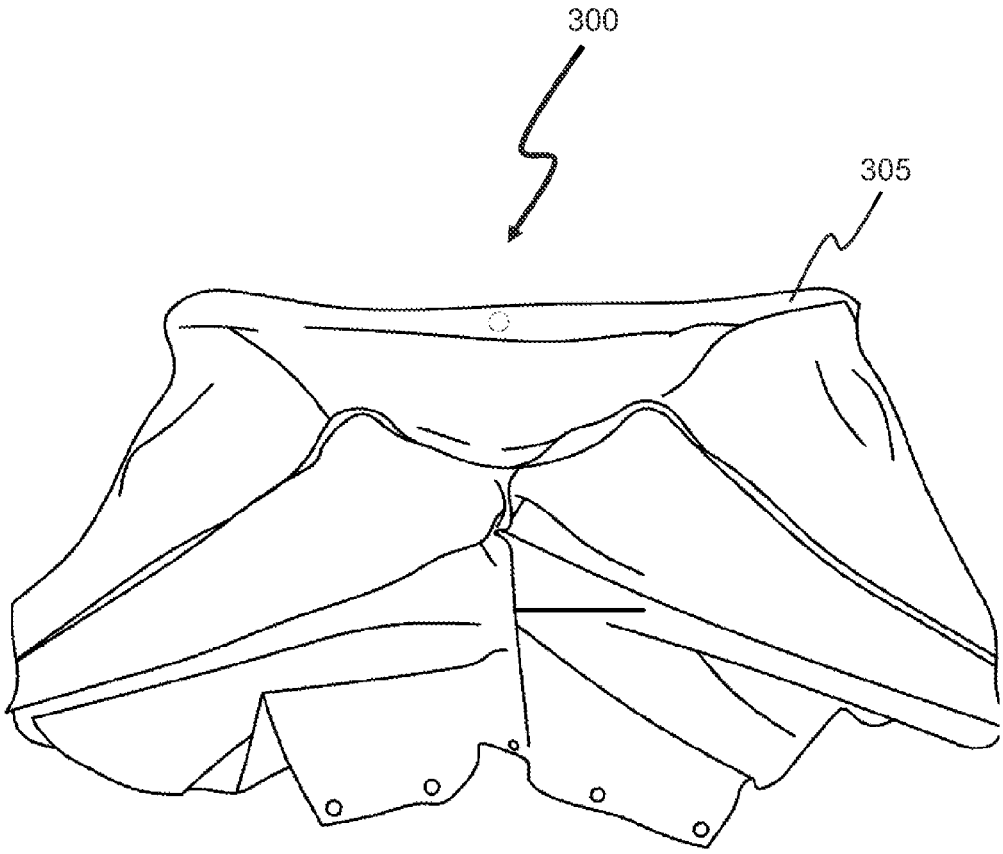
FIG. 3A is a perspective view of an example shorts with inseam unfastened in accordance in this application.
Figure 3B:
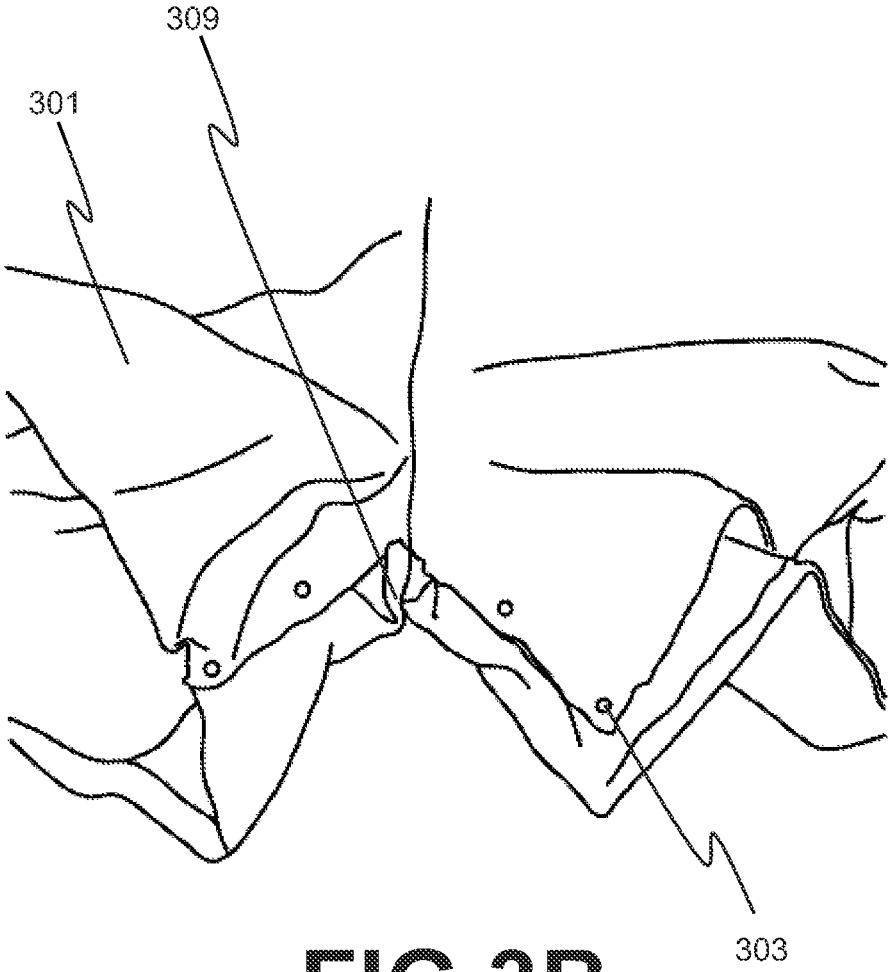
FIG. 3B is a perspective view of an example shorts with inseam fastened in accordance in this application.
Figure 3C:
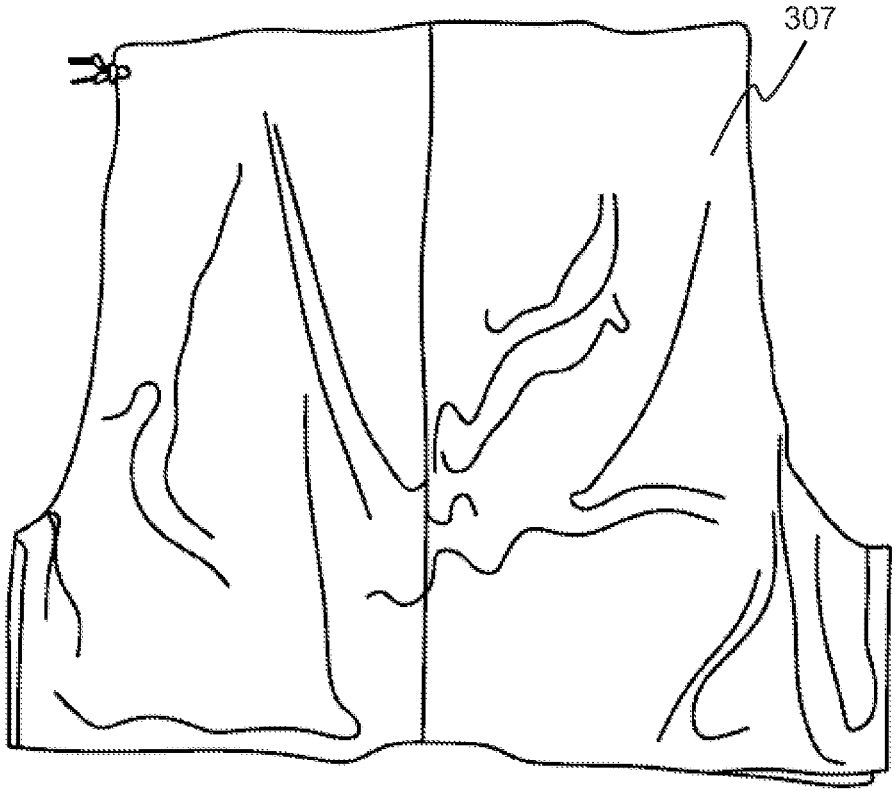
FIG. 3C is a perspective view of an example shorts unfastened side in accordance in this application.
Figure 3D:
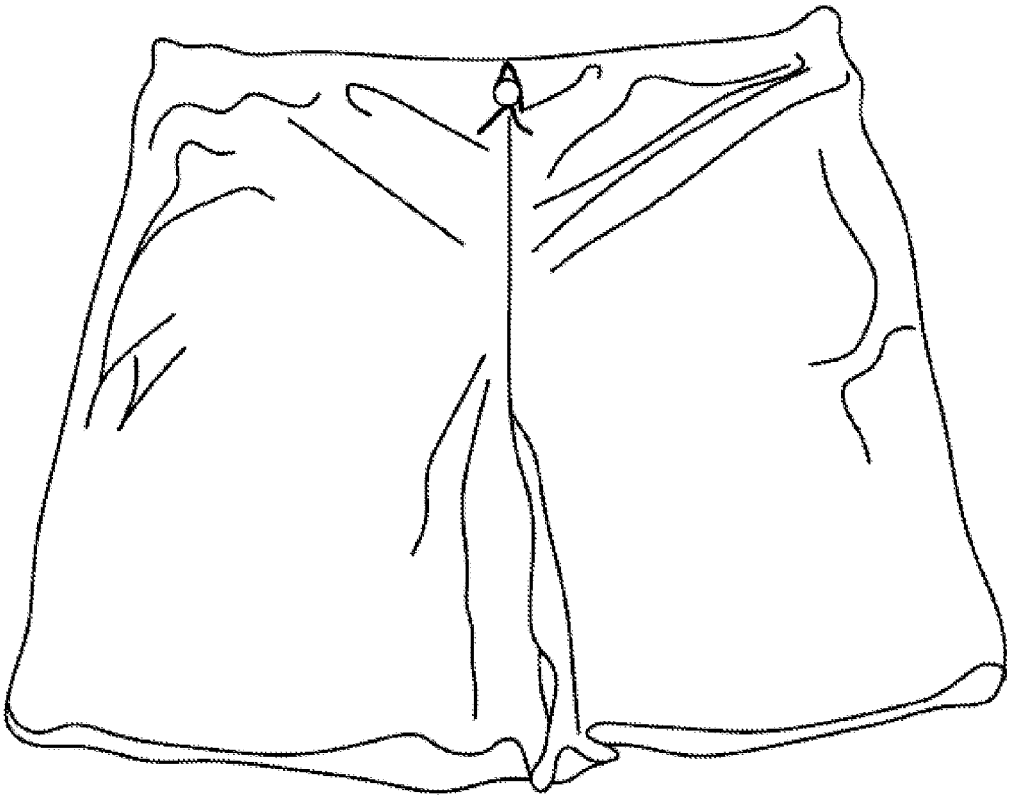
FIG. 3D is a perspective view of an example shorts front in accordance in this application.
Figure 3E:
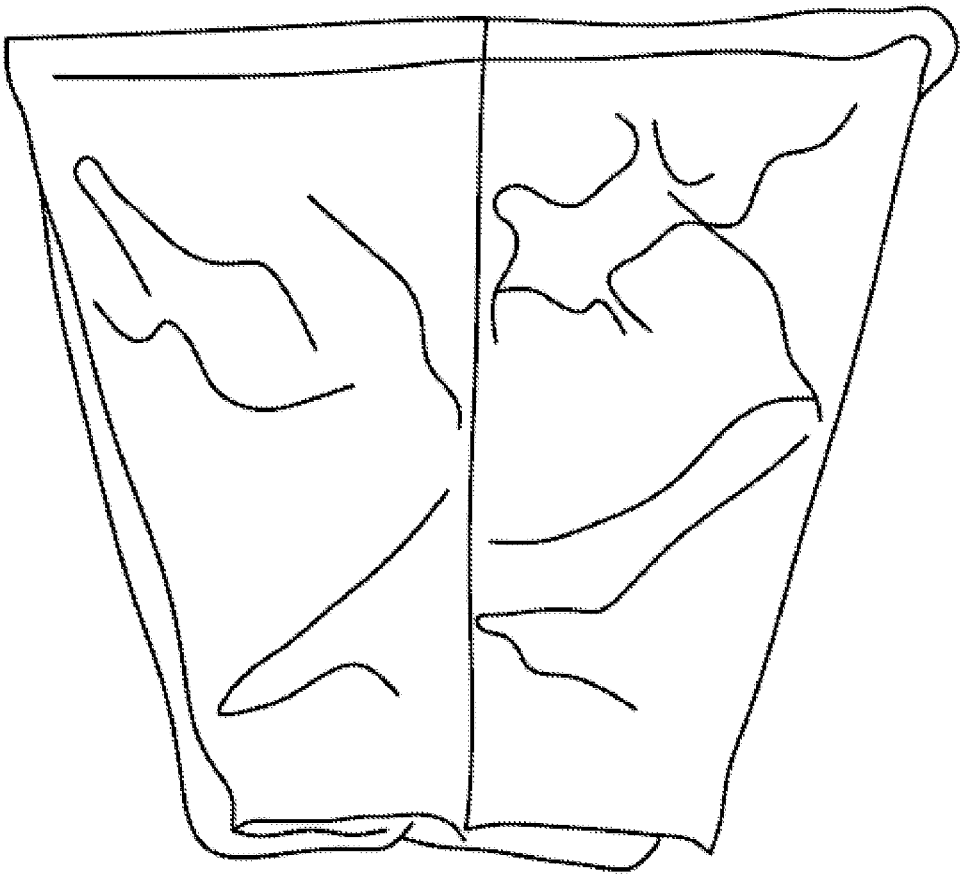
FIG. 3E is a perspective view of an example shorts side in accordance in this application.

In reference to FIGS. 2A to 2E, shower top 200 is a shirt tank design that is constructed in three panels, two front panels 203 and one back panel 207. As shown in FIGS. 2D and 2E, the front panels and the back panel are seamed together at the side while the two front panels remain open and can be buttoned together. Two front panels 203 join in the front in between the "cups," the fabric of the front panels are not sewn together. The panels are hemmed and fastened with snap fasteners 201 that run vertically. Other types of fastener options include Velcro®, magnetic buttons and sewing. The panels are oversized in design.

Shower top 200 has a loose fitting waistband that is sewn into the bottom of the shower top 200. Within the waistband, drawstring 205 is inserted so the waistband can be cinched. There are buttonholes sewn at the front of the waistband to where the drawstring extends. A cord stop is used to keep the drawstring tight while keeping the hands free. One side of the drawstring is able to be removed from the cord stop and can be easily replaced into the cord stop. This allows for front panels to be completely separated. When snaps 201 are unfastened and the drawstring is loosened, shower top 200 can be easily removed if clothes are worn underneath. In addition, if other clothes are worn, the shower top 200 can be easily put on over the clothing and then the user can dress or disrobe with sufficient privacy.

Two shoulder straps 209 extend upwards from front panels 203 and back panel 207, and join at the top of each shoulder. The ends of each strap are hemmed and fastened with snap fasteners. Other types of fastener options include Velcro®, magnetic buttons and sewing.

In reference to FIGS. 3A to 3E, shower shorts 300 are constructed in four panels, two front panels 301 and two back panels 307. Seams are sewn with one down in the back side and in the front side. The bottom is hemmed and a loose fitting waistband 305 is sewn into the top. Within the waistband, a drawstring is inserted so it can be cinched. Buttonholes are sewn at the front of the waistband to where the drawstring extends. A cord stop is used to keep the drawstring tight while keeping the hands free.

The inseam 309 is not sewn. It is hemmed and fastened with snap fasteners 303. Other types of fastener options include Velcro®, magnetic buttons and sewing. The shower shorts 300 are designed to be oversized, and the inseam is not sewn to allow the shorts to be put on and taken off even if the user is wearing other clothing. When the inseam is unfastened the shower shorts 300 is designed to be like a skirt. If clothes are worn underneath the shower shorts 300, the drawstring is loosened then the shower shorts 300 are able to easily fall to the floor. In addition, if other clothes are worn, the shower shorts 300 can be easily put on over the clothing and then the user can dress or disrobe with sufficient privacy.

The described bathing sets will allow bathers to maintain privacy and dignity while showering in what is all too often a creepy and uncomfortable atmosphere. The bathing sets are washable, durable and reusable. The bathing set is to be worn during a user's shower and allows the user to thoroughly wash and rinse through the garment. The fabric is designed to be loose fitting yet secure as to allow the user to wash and rinse more effectively.

The bathing sets are meant for both male and female users. The shorts may be for the males and a short and top set for the females. The fabric is made of a semi-permeable material that allows for the passage of soap and rinse water from the fabric to the skin. Preferred fabric may be 100% polyester jersey mesh fabric. The fabric will be able to be dried quickly and easily to reduce the water transfer to the user's normal clothing.

When using the shower shorts, simply slip the shower shorts on top of the normal shorts/pants and secure to the waist with the drawstring. With the crotch snaps unfastened, the user can modestly disrobe. Refasten the snaps and shower. Apply soap to the shower shorts and lather. The user can wash and rinse the skin directly through the shower shorts. After the shower, the shower shorts can be pat dry with a towel. To discreetly change back into street clothes, simply unfasten the crotch snaps and shimmy a pair of clean shorts/pants underneath the shower shorts. Loosen the drawstring and take off the shower shorts.

When using the shower top, simply slip on the shower top underneath clothing, for example, a workout top. With the snaps fastened, the user can modestly disrobe. Secure the bottom of the shower top to the torso with the drawstring and shower. Apply soap to the shower top and lather. The user can wash and rinse the skin directly through the shower top. After the shower, pat the shower top dry with a towel. To discreetly change back into street clothes, loosen the drawstring and slip on a clean bra/undergarment underneath the shower top. A clean top can be worn over the shower top. Unfasten all the snaps and the shower top slips right off.

As will be recognized by those skilled in the art, the innovative concepts described in the present application can be modified and varied over a tremendous range of applications, and accordingly the scope of patented subject matter is not limited by any of the specific exemplary teachings given. It is intended to embrace all such alternatives, modifications and variations that fall within the spirit and broad scope of the appended claims.

None of the description in the present application should be read as implying that any particular element, step, or function is an essential element which must be included in the claim scope: THE SCOPE OF PATENTED SUBJECT MATTER IS DEFINED ONLY BY THE ALLOWED CLAIMS. Moreover, none of these claims are intended to invoke paragraph six of 35 USC section 112 unless the exact words "means for" are followed by a participle.

The claims as filed are intended to be as comprehensive as possible, and NO subject matter is intentionally relinquished, dedicated, or abandoned.

What is claimed is:

1. A bathing garment set for showering in an open place, comprising:

a top shirt, oversizedly designed, with a loosely fitting waistband, having a first front panel and a second front panel forming a left front side and a right front side of the top shirt, wherein said first front panel and said second front panel are fastened together with a plurality of first snap fasteners disposed vertically, forming a sealed front side, and unfastening said snap fasteners fully separates the left front side and the right front side and opens the top shirt; and a pair of shorts, oversizedly designed, with a loosely fitting waistband, having a left leg inseam and a right leg inseam, wherein both said left leg inseam and said right leg inseam are fastened with a plurality of second snap fasteners, and unfastening said second snap fasteners makes said shorts a skirt-like, wherein both said top shirt and said shorts are made of a semi-permeable fabric, wherein the top shirt is a shirt-tank in design wherein said first and second front panels extend upwards and form two shoulder straps by merging with a back panel, wherein the top shirt and shorts are comprise as a set but the option is available for them to be worn independently.

2. The bathing garment set of claim 1, wherein said merging is by way of snap fasteners.

3. The bathing garment set of claim 1, wherein the top shirt is a shirt-halter in design wherein first and second front panels extend upwards and join behind the neck.

4. The bathing garment set of claim 3, wherein said joining is by way of snap fasteners.

5. The bathing garment set of claim 1, wherein said semi-permeable fabric is polyester jersey mesh fabric.

* * * * *